US008683629B2

(12) United States Patent
Clenet et al.

(10) Patent No.: US 8,683,629 B2
(45) Date of Patent: Apr. 1, 2014

(54) ARTICULATING BED WITH LUMBAR AND HEAD ADJUSTMENT

(71) Applicant: Ergomotion, Inc., Santa Barbara, CA (US)

(72) Inventors: Alain Clenet, Santa Ynez, CA (US); Joseph Ermalovich, Santa Barbara, CA (US)

(73) Assignee: Ergomotion, Inc., Santa Barbara, CA (US)

( * ) Notice: Subject to any disclaimer, the term of this patent is extended or adjusted under 35 U.S.C. 154(b) by 0 days.

(21) Appl. No.: 13/931,243

(22) Filed: Jun. 28, 2013

(65) Prior Publication Data

US 2014/0000033 A1 Jan. 2, 2014

Related U.S. Application Data

(60) Provisional application No. 61/665,829, filed on Jun. 28, 2012.

(51) Int. Cl.
*A61G 7/015* (2006.01)
*A61G 7/018* (2006.01)

(52) U.S. Cl.
USPC ..... 5/613; 5/612; 5/616; 5/617; 5/600

(58) Field of Classification Search
USPC ..... 5/618, 617, 616, 613, 612, 600, 5/620–622, 632–634, 640, 722, 723, 933, 5/934, 937, 236.1
See application file for complete search history.

(56) References Cited

U.S. PATENT DOCUMENTS

| | | | | | |
|---|---|---|---|---|---|
| 1,866,696 | A * | 7/1932 | Birman | 5/612 |
| 3,041,121 | A * | 6/1962 | Comper | 5/618 |
| 3,041,122 | A * | 6/1962 | Weickgenannt et al. | 5/614 |
| 3,281,141 | A * | 10/1966 | Smiley et al. | 5/614 |
| 3,754,749 | A * | 8/1973 | Lyon et al. | 5/618 |
| 4,678,171 | A * | 7/1987 | Sanders et al. | 5/618 |
| 4,882,797 | A * | 11/1989 | Failor et al. | 5/613 |
| 5,640,730 | A * | 6/1997 | Godette | 5/618 |
| 6,874,182 | B2 * | 4/2005 | L'Hegarat et al. | 5/612 |
| 7,036,165 | B2 * | 5/2006 | Weinman et al. | 5/617 |
| 7,159,255 | B2 * | 1/2007 | Piraino | 5/238 |
| 7,325,265 | B2 * | 2/2008 | Hornbach et al. | 5/618 |
| 7,540,048 | B2 * | 6/2009 | Piraino | 5/613 |
| 7,900,302 | B2 * | 3/2011 | Long | 5/618 |
| 8,418,290 | B2 * | 4/2013 | Shih | 5/616 |
| 8,418,291 | B2 * | 4/2013 | Hornbach et al. | 5/618 |
| 8,484,777 | B2 * | 7/2013 | Shih | 5/109 |
| 2004/0083549 | A1 * | 5/2004 | L'Hegarat et al. | 5/621 |
| 2004/0098805 | A1 * | 5/2004 | Piraino | 5/613 |
| 2004/0194213 | A1 * | 10/2004 | Weinman et al. | 5/618 |
| 2006/0021145 | A1 * | 2/2006 | Hornbach et al. | 5/618 |
| 2006/0026765 | A1 * | 2/2006 | Hornbach et al. | 5/618 |

(Continued)

*Primary Examiner* — Robert G Santos
(74) *Attorney, Agent, or Firm* — Felix L. Fischer

(57) ABSTRACT

An articulating bed incorporates a support frame having an upper body support section. A lumbar actuation lever extends from a rotatable torque tube with angle arms extending from the torque tube to a lumbar support element. The lumbar support element is retracted against the upper body support section creating minimal deflection in a lumbar region of a mattress. The torque tube is rotated with to elevate the lumbar support element. A head support bracket is mounted to a neck angle adjustment section. The neck angle adjustment section is aligned with the upper body support section. or rotated about hinge elements to provide an angled head and neck position with respect to the upper body support section.

6 Claims, 9 Drawing Sheets

(56) References Cited

U.S. PATENT DOCUMENTS

| | | | | |
|---|---|---|---|---|
| 2007/0214571 | A1* | 9/2007 | Piraino | 5/616 |
| 2008/0127421 | A1* | 6/2008 | Hornbach et al. | 5/618 |
| 2009/0094748 | A1* | 4/2009 | Long | 5/613 |
| 2009/0178201 | A1* | 7/2009 | Lujan et al. | 5/618 |
| 2010/0017964 | A1* | 1/2010 | Kruse | 5/604 |
| 2012/0159712 | A1* | 6/2012 | Lee | 5/613 |
| 2012/0174316 | A1* | 7/2012 | Shih | 5/600 |
| 2013/0025066 | A1* | 1/2013 | Shih | 5/694 |

* cited by examiner

ARTICULATING BED WITH LUMBAR AND HEAD ADJUSTMENT

REFERENCES TO RELATED APPLICATIONS

This application claims priority of US provisional application Ser. No. 61/665,829 filed on Jun. 28, 2012 having the same title as the present application, the disclosure of which is incorporated herein by reference.

BACKGROUND

1. Field

This invention relates generally to the field of adjustable beds and more particularly to a structure for an articulating bed having an integral adjustable lumbar support with cylindrical mattress interface and a head angle adjustment with segregated drive actuator.

2. Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

The mechanical structure and drive mechanisms for such articulating beds must be able to support the weight of both a mattress and the occupant. Due to the size, weight, fabrication materials and configuration of the mattress and supporting structure, maintaining rigidity in the system may also be challenging. Typical articulating beds provide an upper body positioning element and a thigh and lower leg positioning element either individually active or with combined actuation. One noted disadvantage of articulating bed systems when both the upper body positioning element and the leg positioning elements are elevated is the tendency for positioning of the lower back in a curved posture which may result in undesirable lumbar strain. Lumbar positioning or support elements have been proposed. However, adjustment elements have tended to adversely reposition, strain or damage the mattress.

Similarly, head angle with most articulated beds with the upper body positioning element in the elevated position is not satisfactory due to the linear alignment of the head and body. Adjustment systems for creating an angled relationship between the upper body portion of the mattress and a portion wherein the head rests have also been available but actuation systems have proved to be complicated or unsightly since the upper body portion articulating element is exposed in the elevated position It is therefore desirable to provide an articulating bed having lumbar support adjustment with reduced mattress interference and a head portion adjustment with simple and unimposing actuation elements.

SUMMARY

The embodiments disclosed herein overcome the shortcomings of the prior art by providing an actuating mechanism for an articulating bed which incorporates a support frame for an articulating section having a seat section and an upper body support section. An actuator with a ram is pivotally attached to the upper body support section with a bracket. A lumbar actuation lever is pivotally attached to the ram and extends from a torque tube rotatable in bearing blocks mounted to the upper body support section. Angle arms extend from the torque tube and are attached to a lumbar support element through apertures in the upper body support section. The lumbar support element is retracted against the upper body support section with the ram in a first position creating minimal deflection in a lumbar region of a mattress supported on the upper body support section. The torque tube is rotated with the ram in a second position extending the angle arms through apertures to elevate the lumbar support element. A second actuator having a second ram is pivotally supported by a second bracket extending from a brace element of an actuation mechanism of the upper body support section. A head support bracket is pivotally attached to the second ram and mounted to a neck angle adjustment section. The neck angle adjustment section is aligned with the upper body support section with the second ram in a first position. The bracket is urged to rotate the neck angle adjustment section about hinge elements to provide an angled head and neck position with respect to the upper body support section with the second ram in a second position.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
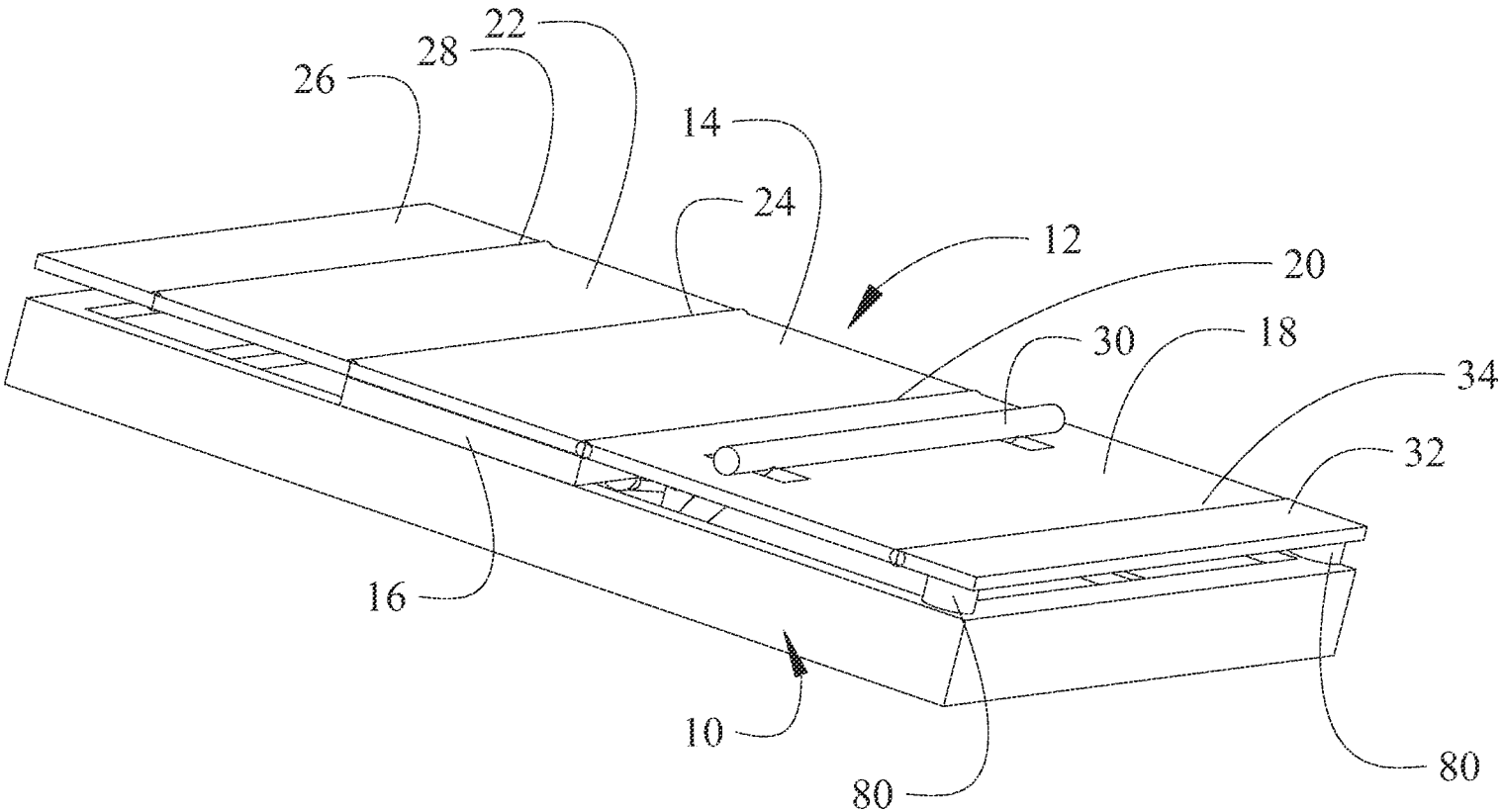
FIG. 1 is a top isometric partial view of an articulating bed system employing an example embodiment in a fully retracted or unarticulated position with the mattress removed for clarity.

Embodiments shown in the drawings and described herein provide an actuation system for an articulating bed which incorporates within an elevating upper body support section an integral lumbar support adjustment mechanism and a neck angle adjustment mechanism. The lumbar support adjustment mechanism is engaged with a single actuator for extension from a base or retracted position to an extended position and employs a cylindrical or semi-cylindrical interface to the mattress bottom to preclude shifting or catching of the mattress during extension or retraction. The neck angle adjustment mechanism is activated by an actuator supported on existing structure for articulation of the upper body section to simplify and integrate the mechanism for aesthetic appearance.

Figure 2A:
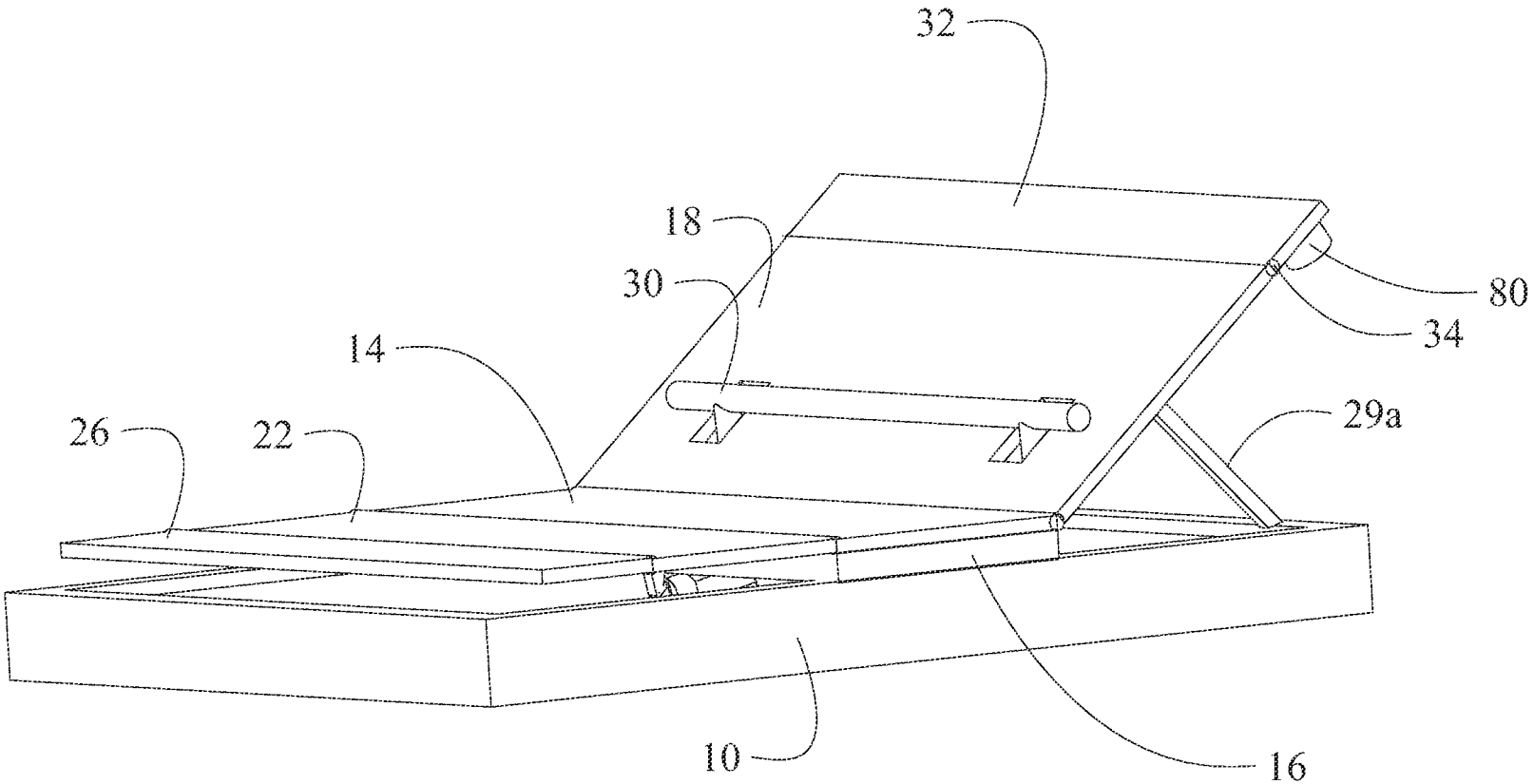
FIGS. 2A and 2B are a top isometric partial views of the articulating bed system of FIG. 1 with the upper body section elevated and the lumbar and neck support mechanisms in a retracted position with the mattress removed for clarity.
Figure 2B:
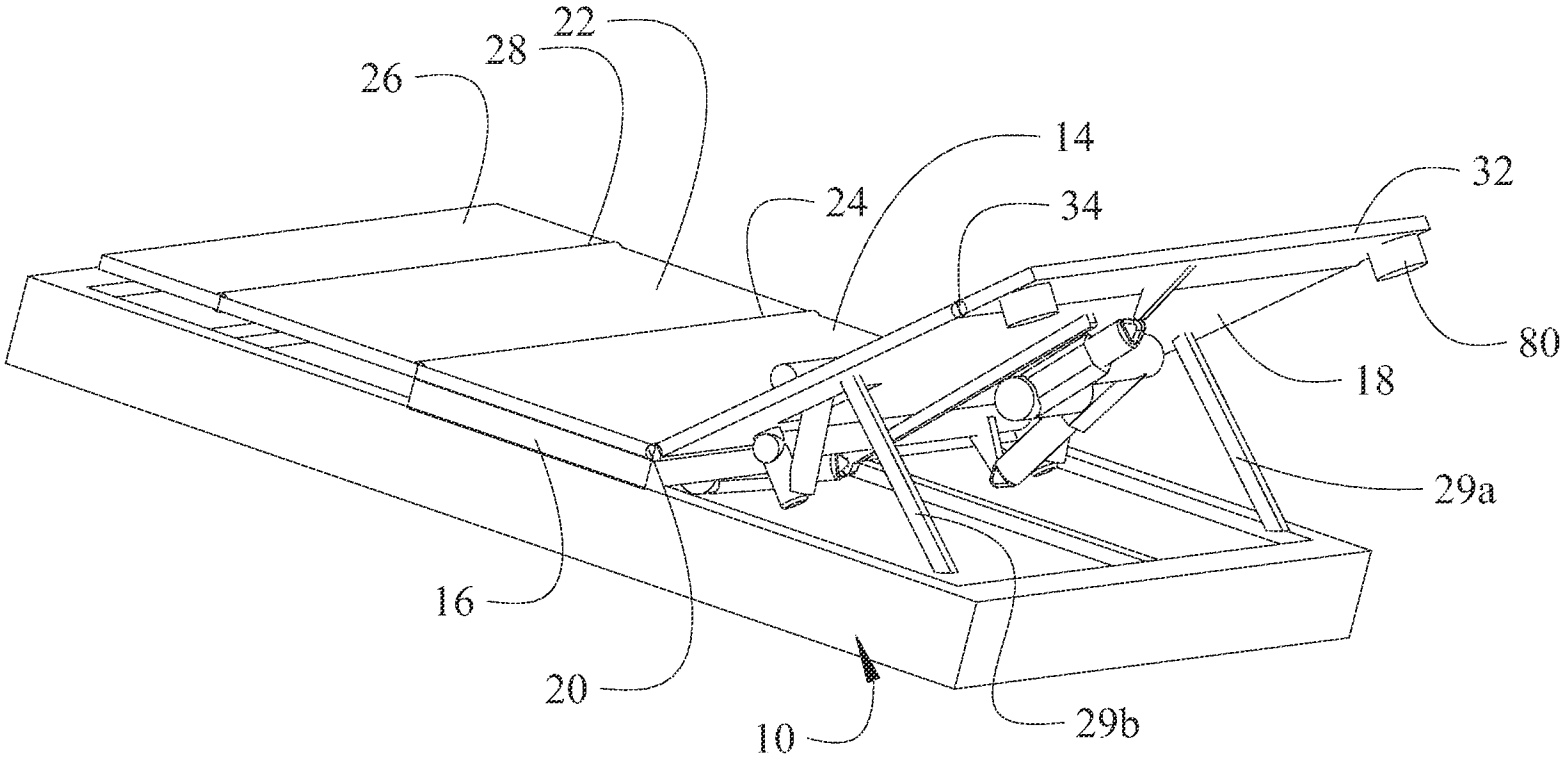

Referring to the drawings, FIGS. 1 and 2 show an articulating bed system employing an example embodiment of the present invention. The bed system includes a support frame 10 and articulation system 12. The articulation system includes a seat section 14, which for the embodiment shown is mounted on a seat carriage 16 which is mounted on the support frame 10. An upper body support section 18 is attached to the seat section 14 with hinge elements 20. A thigh support section 22 is attached to the seat section 14 with hinge elements 24 and a foot support section 26 is attached to the thigh support section 22 with hinge elements 28. Operation of the articulation system may be accomplished as described in U.S. Pat. No. 7,930,780 entitled ADJUSTABLE BED FRAME ASSEMBLY having a common assignee with the present application, the disclosure of which is incorporated herein by reference. For the embodiment shown in the drawings, the articulation system maintains equal wall distance for an upper extremity of the articulating sections as shown in FIG. 2 by translation of the seat carriage 16 on the support frame 10 induced by support rods 29*a* and 29*b*. In alternative embodiments, a seat section fixed to the support frame may be employed.

A lumbar support element 30 is mounted for actuation, as will be described in greater detail subsequently, in the upper body support section 18. A neck angle adjustment section 32 is mounted to the upper extremity of the upper body support section 18 with hinge elements 34.

Figure 3:
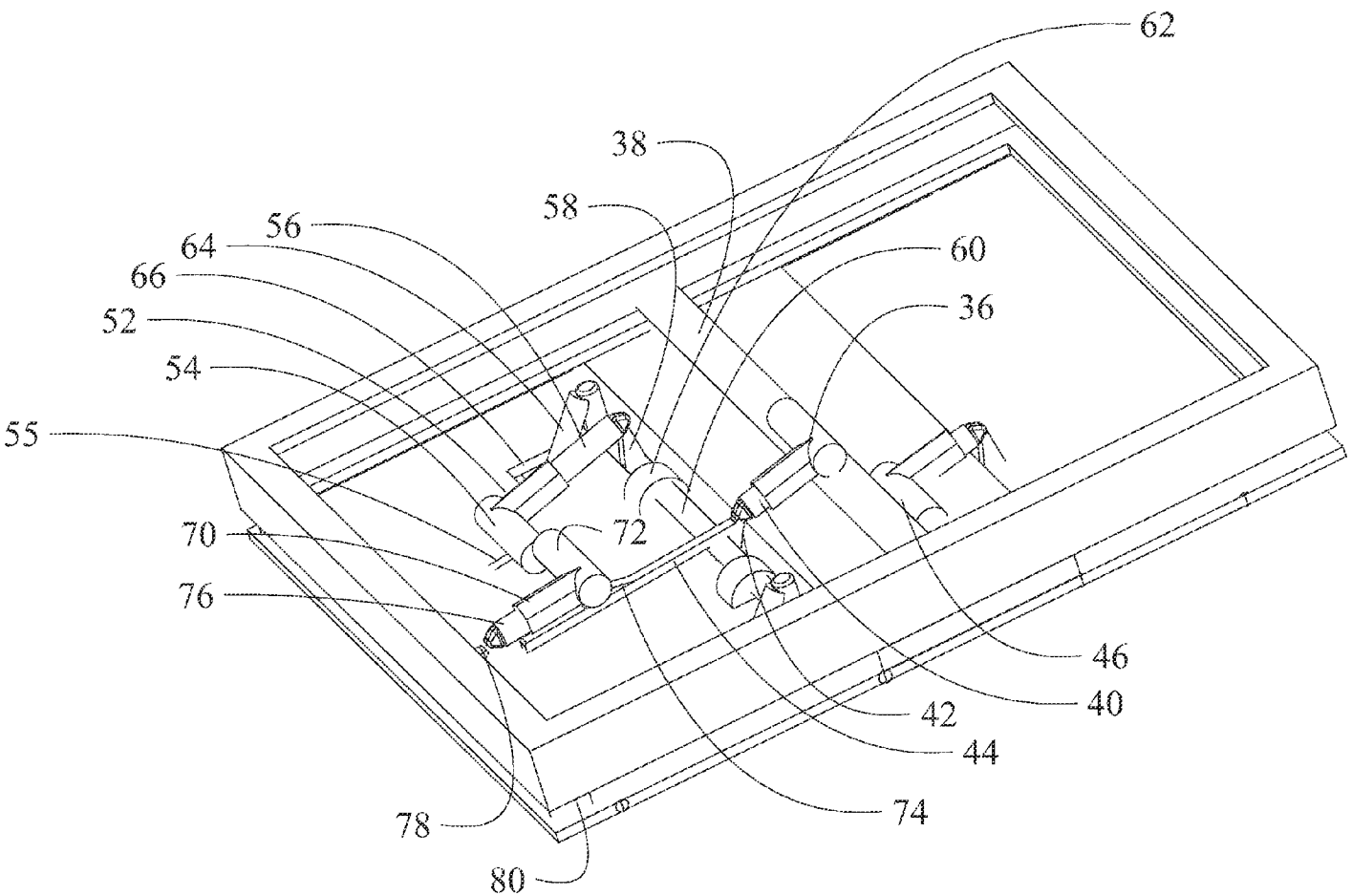
FIG. 3 is a bottom isometric view of the articulating bed system showing the actuation components of the lumbar and neck support mechanisms in the retracted state.

FIG. 3 shows the actuation components for the articulation system. A first actuator 36 supported by a cross member 38 of the support frame 10 incorporates a ram 40 pivotally connected to a lever arm 42 and brace element 44 which are attached as an activation mechanism to the upper body support section 18. Extension of the ram 40 exerts force on the lever arm 42 and brace element 44 causing the upper body support section 18 to rotate about the hinge elements 20 to elevate the upper body support section from the position shown in FIG. 1 to the position shown in FIG. 2. A second actuator 46 mounted to the seat section 14 incorporates a ram 48 pivotally connected to a lever arm 50 attached to the thigh support section. Extension of the ram 48 exerts force on the lever arm 50 to rotate the thigh support section 22 about hinge elements 24.

Figure 4:
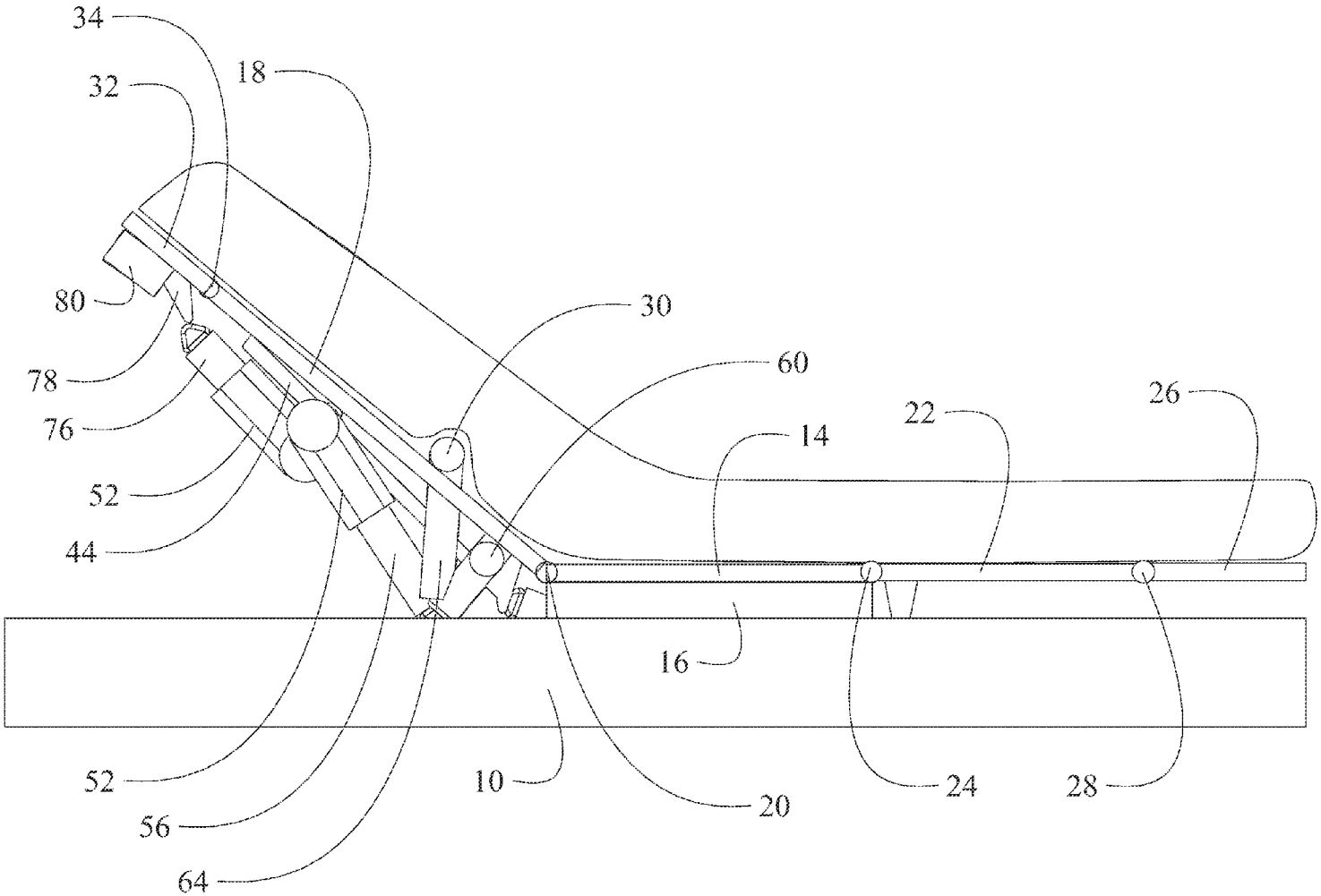
FIG. 4 is a side view of the articulating bed system of FIG. 1 with the upper body portion elevated and the lumbar and neck support mechanisms in a retracted position showing the mattress as installed.

A lumbar support adjustment mechanism 52 incorporates an actuator 54 which is pivotally attached to the upper body support section 18 with bracket 55. Actuator 54 includes a ram 56 which is pivotally attached to a lumbar actuation lever 58. Actuation lever 58 is extends from a torque tube 60 which is rotates in bearing blocks 62 mounted to the upper body support section 18. Angle arms 64 extend from the torque tube 60 and attach to lumbar support element 30 through apertures 66 in the upper body support section 18. With ram 56 in the extended position, lumbar support element 30 is retracted against the upper body support section 18 creating minimal deflection of the mattress 68 in the lumbar region as shown in FIG. 4.

Figure 5A:
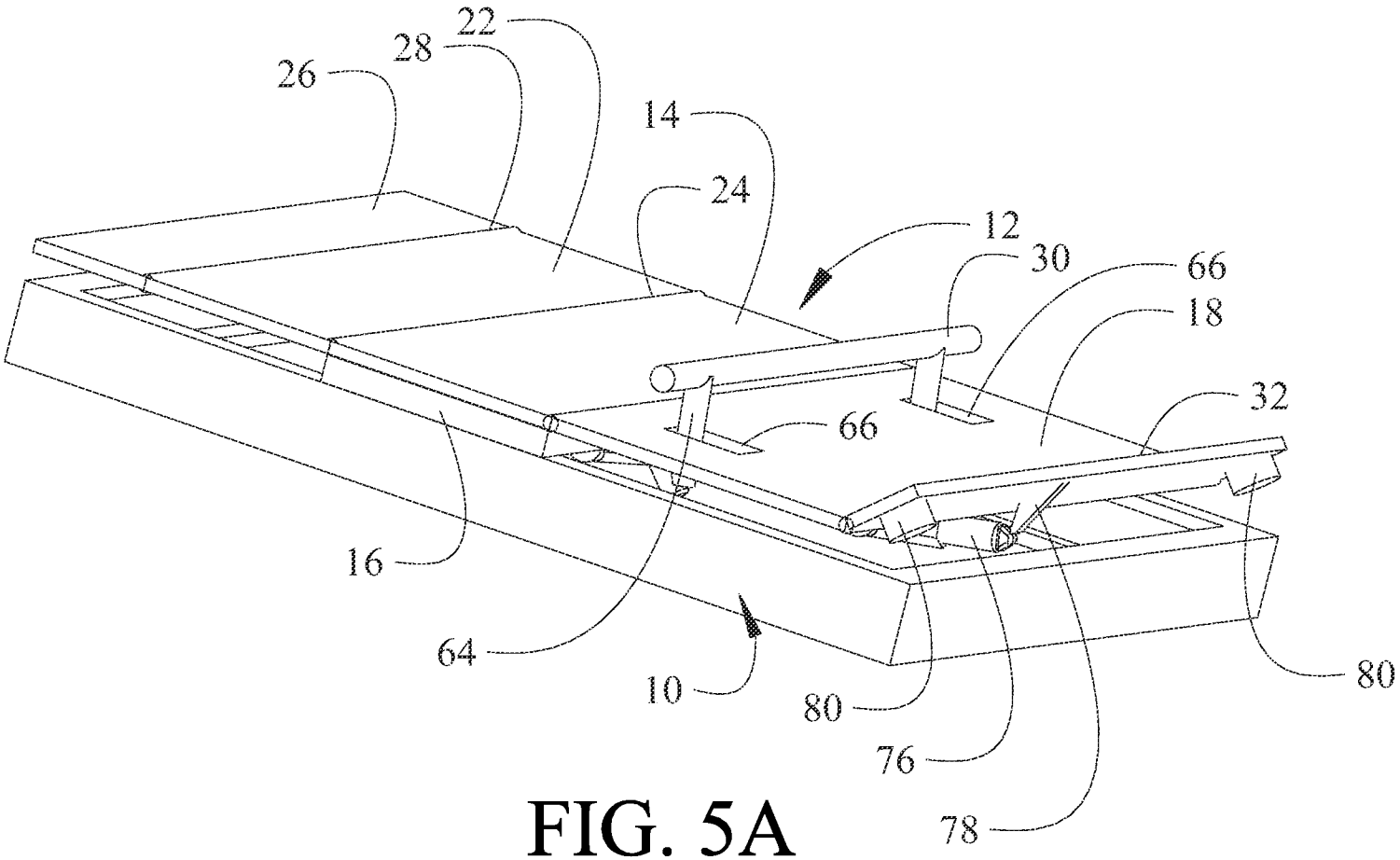
FIGS. 5A and 5B are top isometric view of the articulating bed system with the lumbar and neck support mechanisms elevated with the upper body portion in an unelevated position with the mattress removed for clarity.
Figure 5B:
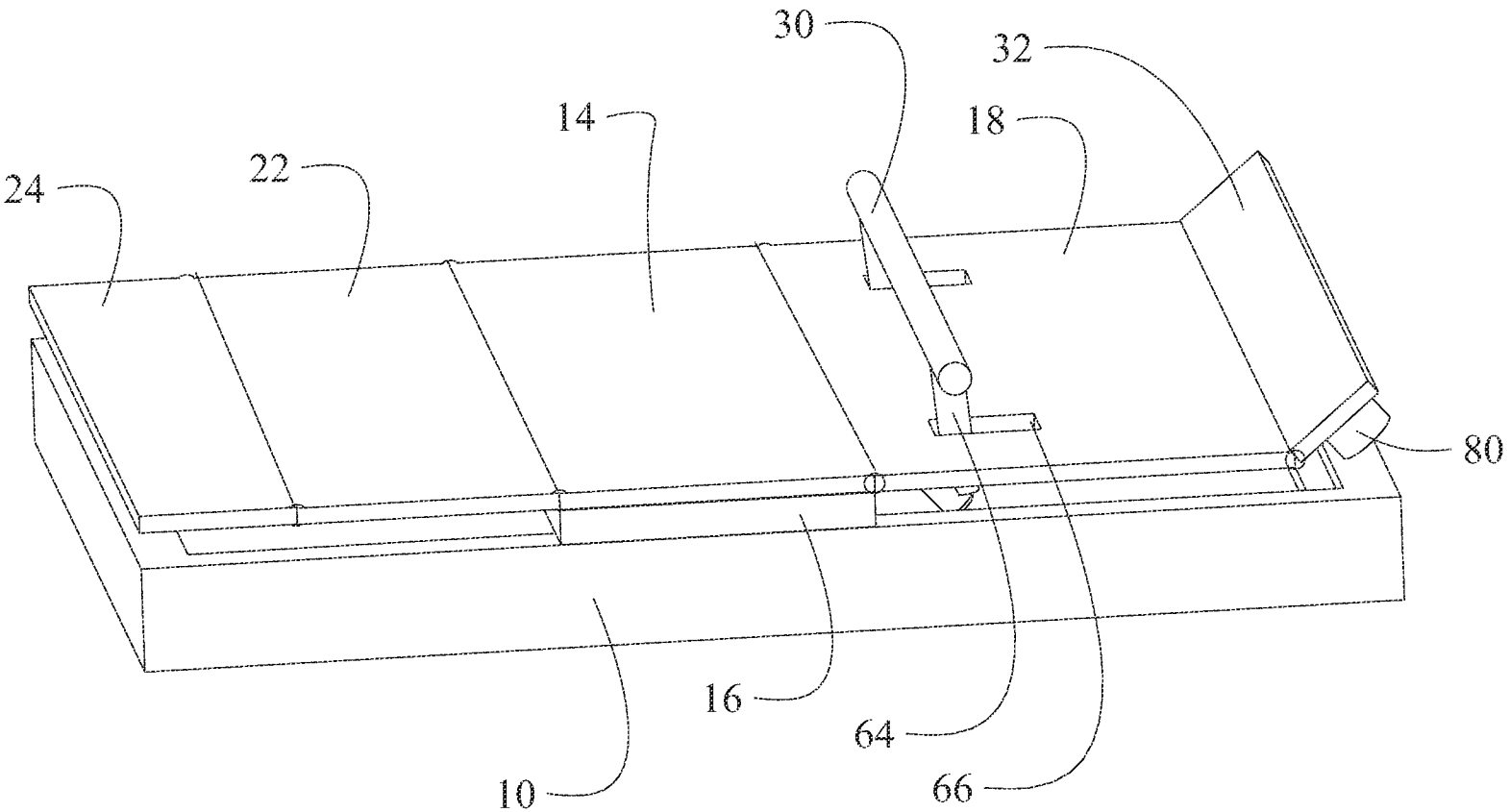
Figure 6:
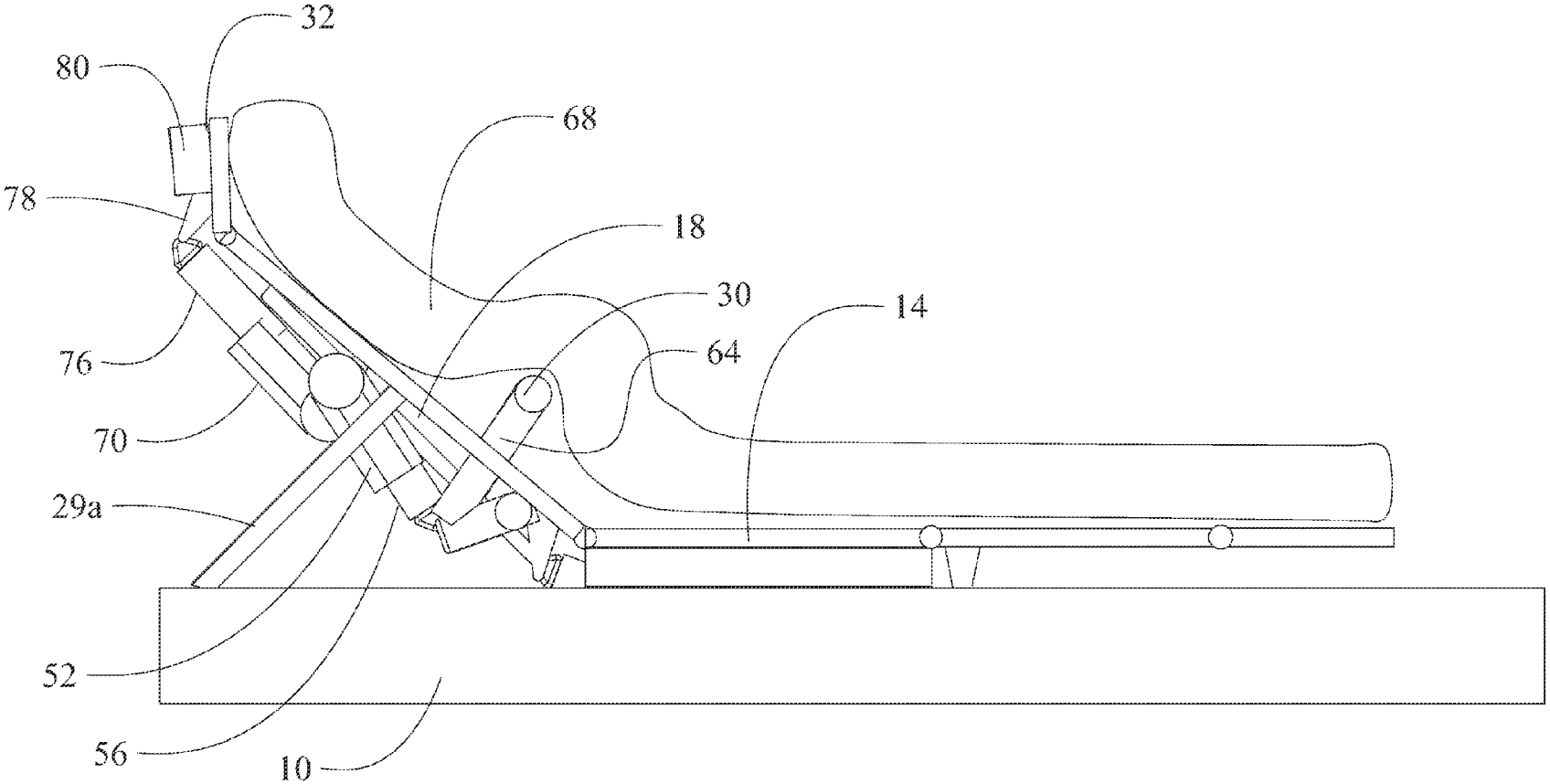
FIG. 6 is a side view of the articulating bed system of FIG. 1 with the upper body portion elevated and the lumbar and neck support mechanisms in an extended position showing the mattress as installed.

Retraction of the ram 56 urges actuation lever 58 to rotate the torque tube 60 extending the angle arms 64 through apertures 66 to elevate the lumbar support element 30 as shown in FIGS. 5 and 6. The cylindrical shape of the lumbar support element 30 smoothly translates against the lower surface of mattress 68 to preclude grabbing or constricting of the mattress during extension or retraction of the lumbar support element. In alternative embodiments, rollers may be employed integral to the lumbar support element for even greater lubricity in contact between the lumbar support element and the mattress lower surface.

Figure 7:
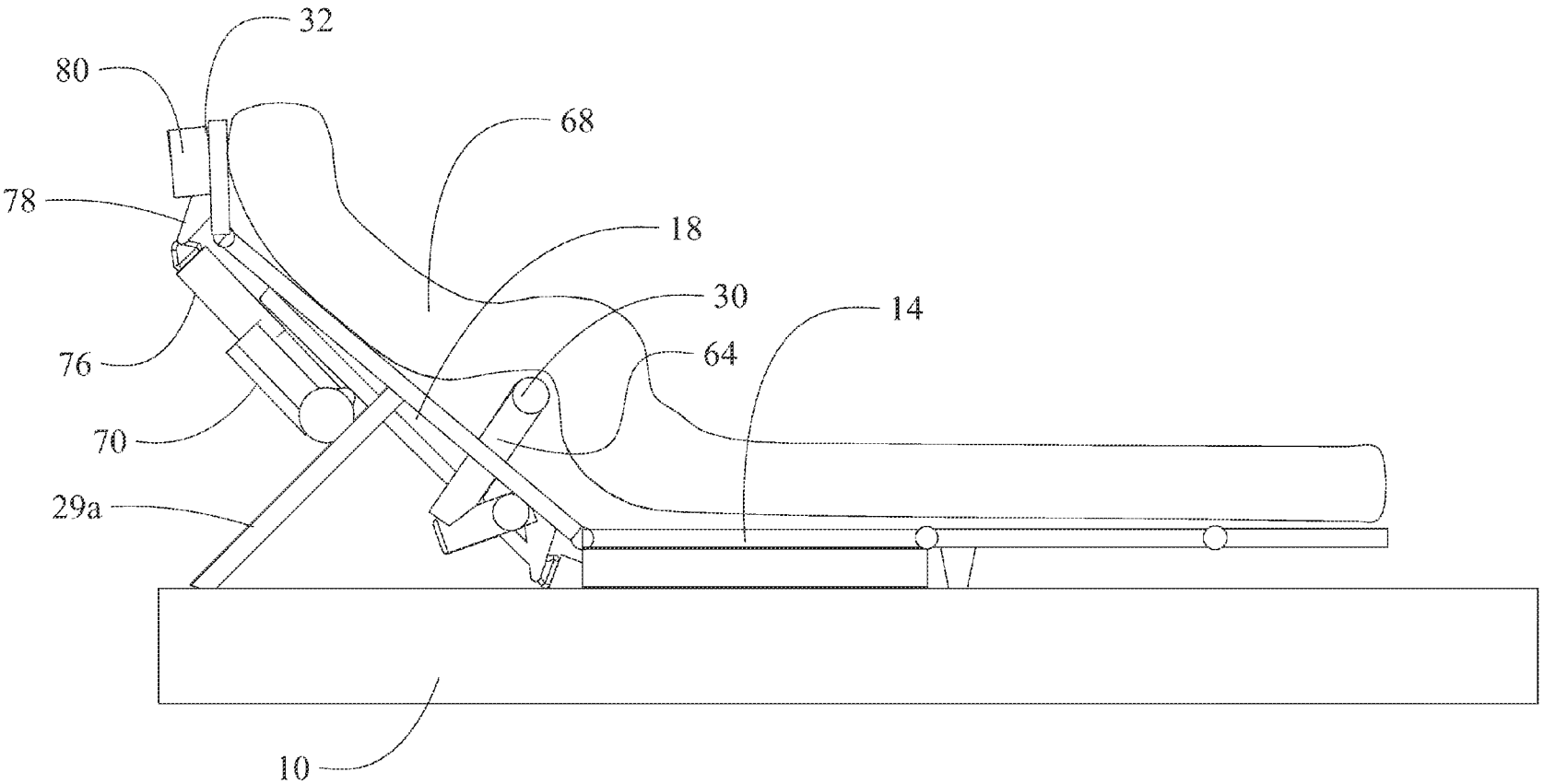
FIG. 7 is a side view of the articulating bed system of FIG. 1 with the upper body portion elevated and the lumbar and neck support mechanisms in an extended position with the lumbar support adjustment mechanism removed for clarity of the neck angle adjustment mechanism.

Returning to FIG. 3, a neck angle adjustment mechanism 70 employs an actuator 72 which is pivotally supported by bracket 74 extending from the brace element 44 of the actuation mechanism of the upper body support section 18. Actuator 72 incorporates a ram 76 which is pivotally attached to a head support bracket 78 mounted to the neck angle adjustment section 32. With ram 76 in a retracted position, neck angle adjustment section 32 remains aligned with upper body support section 18 as shown in FIGS. 1, 2 and 4. Extension of ram 76 urges bracket 78 to rotate the neck angle adjustment section 32 about hinge elements 34 to provide an angled head and neck position with respect to the upper body support section 18 as shown in FIGS. 5 and 7. Mounting of the actuator 72 of the neck angle adjustment mechanism directly to the upper body support section 18 provides a simplified mechanical architecture for operation of the neck angle adjustment section. Substantial alignment of the actuator 72 and actuator 54 of the lumbar support adjustment mechanism provides for an aesthetically pleasing visual arrangement of the components which are exposed to view upon elevation of the upper body support section 18 or provides for ease of masking the actuators from view. Further, mounting of the bracket 74 integrated with the brace element 44 of the actuation mechanism of the upper body support section 18 reduces parts and increases strength by having the components push against each other. In alternative embodiments, the actuator 72 may be mounted directly to the upper body support section like the actuator 54 of the lumbar support adjustment mechanism 52 previously described. In other alternative embodiments, the actuator 54 may also be mounted from the brace element 44 to even more compactly arrange the components.

As seen in FIGS. 1, 3, 5 and 7, support pedestals 80 may be mounted to the neck angle adjustment section 32 to engage the support frame 10 with the upper body support section 18 and the neck angle adjustment section 32 in the unelevated positions for firm support.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A lumbar support adjustment mechanism for an articulating bed comprising:

an actuator pivotally attached to an upper body support section with a bracket, said actuator including a ram;

a lumbar actuation lever pivotally attached to the ram and extending from a torque tube rotatable in bearing blocks mounted to the upper body support section;

angle arms extending from the torque tube and attached to a lumbar support element through apertures in the upper body support section;

said lumbar support element retracted against the upper body support section with the ram in a first position creating minimal deflection in a lumbar region of a mattress supported on the upper body support section and said torque tube rotated with the ram in a second position extending the angle arms through the apertures to elevate the lumbar support element.

2. The lumbar support adjustment mechanism as defined in claim 1 wherein the lumbar support element is substantially cylindrical for contact with a mattress resting on the upper body support section.

3. A neck angle adjustment mechanism for an articulating bed comprising:

an actuator pivotally supported by a bracket extending from a brace element of an actuation mechanism of an upper body support section, said actuator incorporating a ram;

a head support bracket pivotally attached to the ram and mounted to a neck angle adjustment section;

said neck angle adjustment section aligned with the upper body support section with the ram in a first position, said bracket urged to rotate the neck angle adjustment section about hinge elements mounted to the upper body support section to provide an angled head and neck position with respect to the upper body support section with the ram in a second position.

4. An articulating bed comprising:

a support frame;

an articulating section supported on the support frame and having a seat section and an upper body support section;

an actuator pivotally attached to the upper body support section with a bracket, said actuator including a ram;

a lumbar actuation lever pivotally attached to the ram and extending from a torque tube rotatable in bearing blocks mounted to the upper body support section;

angle arms extending from the torque tube and attached to a lumbar support element through apertures in the upper body support section;

said lumbar support element retracted against the upper body support section with the ram in a first position creating minimal deflection in a lumbar region of a mattress supported on the upper body support section and said torque tube rotated with the ram in a second position extending the angle arms through the apertures to elevate the lumbar support element.

5. An articulating bed comprising:

a support frame;

an articulating section supported on the support frame and having a seat section and an upper body support section;

an actuator pivotally supported by a bracket extending from a brace element of an actuation mechanism of the upper body support section, said actuator incorporating a ram;

a head support bracket pivotally attached to the ram and mounted to a neck angle adjustment section;

said neck angle adjustment section aligned with the upper body support section with the ram in a first position, said bracket urged to rotate the neck angle adjustment section about hinge elements mounted to the upper body support section to provide an angled head and neck position with respect to the upper body support section with the ram in a second position.

6. An articulating bed comprising:

a support frame;

an articulating section supported on the support frame and having a seat section and an upper body support section;

an actuator pivotally attached to the upper body support section with a bracket, said actuator including a ram;

a lumbar actuation lever pivotally attached to the ram and extending from a torque tube rotatable in bearing blocks mounted to the upper body support section;

angle arms extending from the torque tube and attached to a lumbar support element through apertures in the upper body support section;

said lumbar support element retracted against the upper body support section with the ram in a first position creating minimal deflection in a lumbar region of a mattress supported on the upper body support section and said torque tube rotated with the ram in a second position extending the angle arms through the apertures to elevate the lumbar support element;

a second actuator pivotally supported by a second bracket extending from a brace element of an actuation mechanism of the upper body support section, said second actuator incorporating a second ram;

a head support bracket pivotally attached to the second ram and mounted to a neck angle adjustment section;

said neck angle adjustment section aligned with the upper body support section with the second ram in a first position, said bracket urged to rotate the neck angle adjustment section about hinge elements mounted to the upper body support section to provide an angled head and neck position with respect to the upper body support section with the second ram in a second position.

* * * * *